US005785833A

United States Patent [19]

Vaughan

[11] Patent Number: 5,785,833

[45] Date of Patent: Jul. 28, 1998

[54] PROCESS FOR REMOVING IRON FROM TIN-PLATING ELECTROLYTES

[76] Inventor: Daniel J. Vaughan, P. O. Box 258, Rockland, Del. 19732-0258

[21] Appl. No.: 638,676

[22] Filed: Apr. 29, 1996

[51] Int. Cl.[6] ..... B01D 59/42; C25B 1/00

[52] U.S. Cl. ..... 204/525; 205/508; 205/509

[58] Field of Search ..... 205/509, 101, 205/746, 747, 748, 749, 750, 770, 771; 210/665

[56] References Cited

U.S. PATENT DOCUMENTS 4,636,288 1/1987 Vaughan ..... 204/182.4

5,310,465 5/1994 Vaughan ..... 205/750

5,451,323 9/1995 Akao et al. ..... 210/665

*Primary Examiner*—Kathryn L. Gorgos

*Assistant Examiner*—Edna Wong

[57] ABSTRACT

A method is provided for removal of ferrous ions from a tin-plating electrolyte containing stannous ions in a multi-compartmented electrochemical cell equipped to convert the ferrous and stannous ions to insoluble hydroxides. The hydroxides, in an essentially air-oxygen free environment, are separated by selectively dissolving the ferrous hydroxide in an acidic solution and the undissolved stannous hydroxide in the tin plating electrolyte.

6 Claims, 1 Drawing Sheet

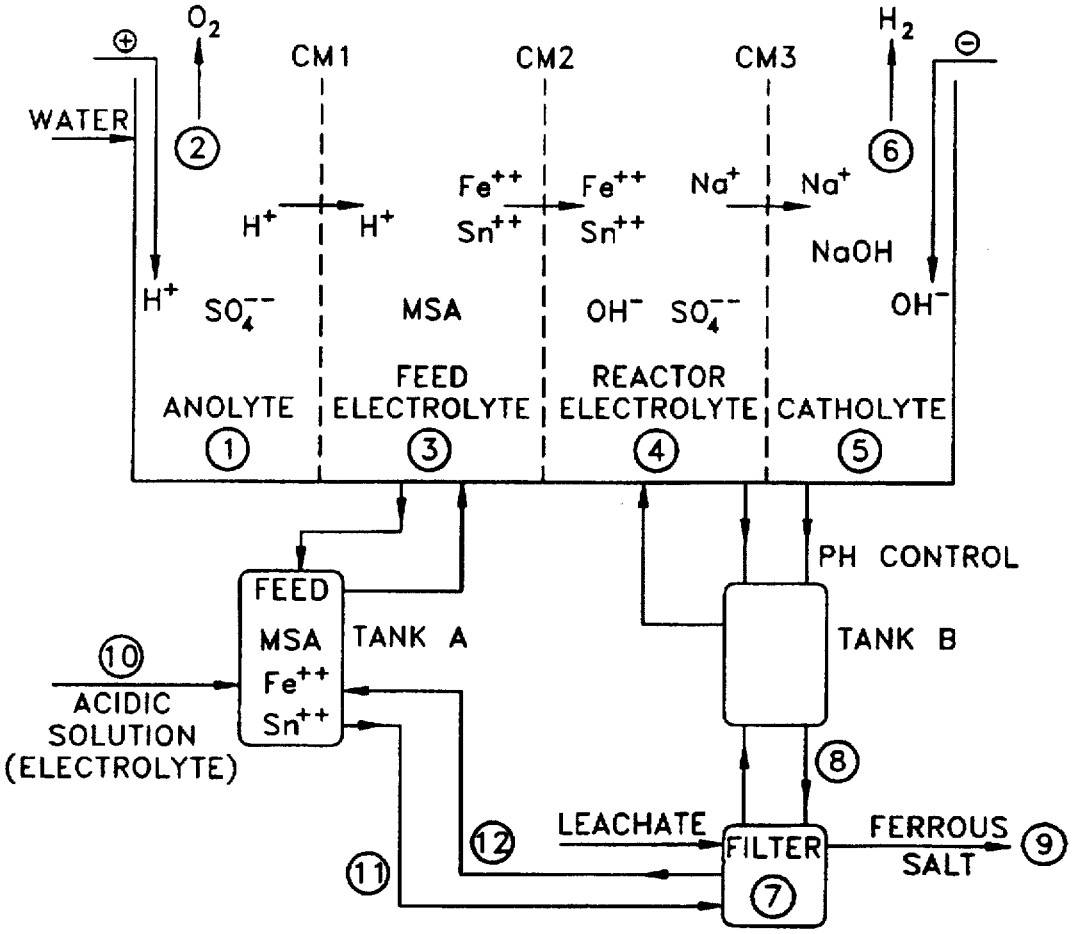
O2
H2
CM1
CM2
CM3
WATER
H+
H+
Fe++
Sn++
Fe++
Sn++
Na+
Na+
NaOH
H+
SO4--
MSA
OH-
SO4--
OH-
ANOLYTE
FEED ELECTROLYTE
REACTOR ELECTROLYTE
CATHOLYTE
PH CONTROL
FEED
MSA
Fe++
Sn++
TANK A
TANK B
ACIDIC SOLUTION (ELECTROLYTE)
LEACHATE
FILTER
FERROUS SALT

PROCESS FOR REMOVING IRON FROM TIN-PLATING ELECTROLYTES

FIELD OF THE INVENTION

This invention relates to a method for separation of metal ions and more specifically for the separation of ferrous and stannous ions in electrolytes used to electroplate tin onto films of steel for making cans and other products.

BACKGROUND OF THE INVENTION

Stannous ions are electroplated onto thin films of steel to make cans. All of the plating electrolytes become contaminated with iron, mostly as ferrous iron, which begins a cyclic oxidation-reduction process. The ferrous ions react with oxygen to form ferric ions and the ferric ions oxidize the stannous ions to stannic ions, a loss of tin, and the ferric ion is reduced to ferrous ions whereby the cycle repeats. The result is that, at a low concentration of iron, there is a large loss of stannous tin and a loss in quality of the tin deposit. It is desirable, therefore, to keep the concentration of iron in the electrolyte to a very low level, preferably in the range of five grams per liter.

Steel strips or thin films of steel are usually electrocoated with tin on all surfaces at strip speeds of about 600 meters/min in vertical and horizontal cells operating in series. Start-up and shut-down of these lines is costly in labor and loss of production.

The composition of the plating electrolyte must be carefully tailored for these high line speeds and closely maintained for consistent high quality deposits. The electrolytes usually contain two or more materials to aid in forming a uniform deposit and to minimize changes in plating efficiency when the electrolyte is exposed to air.

A sodium ferricyanide precipitation method is now used in the "halogen" fluoride electrolyte process for removal of iron. The precipitates are formed in the electrolyte and contribute to a large toxic waste and a major housekeeping problem related to removal of the ferro ferri cyanide solids. An alternate method is to drag-out the plating electrolyte and convert it to waste at the rate required to maintain the desired concentration of iron in the electrolyte. The art is essentially silent on a method to remove iron from the plating electrolyte that (a) does not form precipitates in the electrolyte; (b) does not form a toxic or hazardous waste; and (c) does not adversely affect quality of the tin deposit. A preferred method would continuously remove the iron without loss of the stannous tin and maintain the efficacy of plating at high production rates. This would reduce mill cost and substantially reduce waste to the environment. An object of the instant invention is to provide the preferred process for removal of iron.

Recently the LeaRonal company developed and demonstrated a new electrolyte for plating tin onto steel strips. This electrolyte, designated Ronastan TP, is based on methane sulfonic acid, stannous tin and additives to aid the plating process. This electrolyte offers an environmental advantage over the fluoride electrolyte and potential advantages in the thickness and quality of the tin deposit and cost of manufacture. There is, however, no satisfactory method for commercially removing iron from this electrolyte. One objective of this invention is to provide a method for continuously maintaining the preferred concentration of iron in the Ronastan TP electrolyte by removing the iron at the rate it enters the electrolyte without (a) loss of the stannous ions, additives or methane sulfonic acid; (b) forming a toxic or hazardous waste or solids in the electrolyte; and (c) adversely affecting the efficacy of plating or quality of the tin deposit.

My attempts to remove iron from the electrolyte by electroplating the fin followed by removal of iron by ion-exchange, electrodialysis or selective precipitation were largely unsuccessful because additives were lost, the tin would not readily dissolve in the plating electrolyte and the process was costly and difficult to operate. My attempts to selectively remove the iron by ion exchange using chelating resins was unsuccessful mostly because tin was more selectively removed or the iron was not easily removed in subsequent operations. In all attempts, there was some loss of plating efficiency and quality of the tin deposits.

An electrodialytic method for conversion of salts of multivalent metal cations into insoluble hydroxides of the metal cations and acids of the salt ions is disclosed in my U.S. Pat. No. 4,636,288, the disclosures of which are incorporated herein by reference. These disclosures, however, do not provide a way to separate the metal hydroxides in a way to return the stannous hydroxide and additives to the plating electrolyte without altering the performance of the plating electrolyte. I have now found that stannous and ferrous ions can be electrodialytically removed from the plating electrolyte in a multicompartmented cell and converted to insoluble hydroxides and, in a separate step essentially free of exposing the ferrous ions to oxygen, that the stannous ions can be separated from the ferrous ions and the stannous ions can be returned to the plating without altering the performance of the plating electrolyte. The process is suitable for continuously maintaining the concentration of iron in the plating electrolyte at less than five grams per liter, without a significant loss of tin, without forming a precipitate in the plating electrolyte and without forming a toxic or hazardous waste.

SUMMARY OF THE INVENTION

An electrodialytic process is provided for continuously removing ferrous ions from a plating electrolyte containing stannous ions and additives. Stannous and ferrous ions are electrodialytically separated from the plating electrolyte in a multicompartmented cell and converted into insoluble hydroxides. The hydroxides are separated in a substantially oxygen-free environment into a ferrous salt and stannous hydroxide by controlling the pH of the separation step. The stannous hydroxide is returned to the plating electrolyte. The process is especially useful for continuously maintaining low concentrations of iron in tin plating electrolytes used by the steel industry without making a hazardous waste.

BRIEF DESCRIPTION OF THE DRAWING

FIG. 1 is a diagram of a process for separation of ferrous ions from a tin-plating electrolyte.

DETAILED DESCRIPTION OF THE INVENTION

Referring to FIG. 1, the process of the instant invention is preferably carried out in an electrochemical cell having an anolyte, a feed electrolyte, a reactor electrolyte and a catholyte. The anolyte is an acidic solution containing an anode. It serves to prevent oxidation of the feed electrolyte by the cell anode. The feed electrolyte is the stannous tin plating electrolyte containing ferrous iron and plating aids. The reactor electrolyte comprises a salt of an acid, preferably sodium sulfate or sodium methane sulfonate, which facilitates electrotransport of metal cations through a cation membrane into a solution containing hydroxide and other anions that insolubilize the metal cations (See U.S. Pat. No. 4,636,288). The catholyte in contact with a cathode is preferably an aqueous solution of an alkali hydroxide. When an electrolyzing current is passed through the cell, (1) water is oxidized at the anode to form oxygen and hydrogen ions; (2) the hydrogen ions pass through membrane CM1 into the feed electrolyte; (3) stannous ions, ferrous ions and other cations pass through membrane CM2 into the reactor electrolyte where they react with hydroxide ions to form hydroxides; (4) soluble cations in the reactor electrolyte, mostly sodium ions, pass through membrane CM3 into the catholyte; (5) water is reduced at the cathode to form hydrogen and hydroxide ions; (6) the hydroxide ions form soluble hydroxides with cations migrating from the reactor electrolyte to the catholyte; (7) the catholyte is fed to the reactor electrolyte to control the pH of the reactor electrolyte as the stannous and ferrous hydroxides are formed as solids; (8) the insoluble stannous and ferrous hydroxides are removed, filtered, from the reactor electrolyte; (9) the solid hydroxides are treated with an acidic solution leachate to form a solution of a ferrous salt and an insoluble stannous hydroxide; (10) the soluble ferrous salt and the insoluble stannous hydroxide are separated; (11) the stannous hydroxide is dissolved, preferably in the feed electrolyte, and made part of the tin plating electrolyte.

The anolyte of the instant process serves to separate the feed electrolyte from the cell anode and prevents oxidation of the ferrous and stannous ions. Any acidic solution can be used as the anolyte. Preferably, the anolyte is a solution of methane sulfonic acid, sulfuric acid or mixtures of these acids to prevent possible contamination of the feed electrolyte with an undesirable anion.

The feed electrolyte could be any acidic solution selected from solutions containing an acid and at least salts of two different metal cations that form insoluble hydroxides, soluble salts, chelates or metal complexes at a different pH. The feed electrolyte may contain additives, a mixture of anions and other cations. The feed electrolyte can be a tin plating electrolyte containing stannous and ferrous ions and additives. The feed electrolyte can be an acidic strip or pickling solution containing stannous, zinc, stannic and ferrous ions.

The reactor electrolyte is an aqueous solution containing a soluble salt of an acid which acid in a one normal solution would have a pH no greater than three and forms a soluble salt with a multivalent metal cation and agents that insolubilize or ionically immobilize multivalent metal cations as disclosed in U.S. Pat. No. 4,636,288. The salt is preferably an alkali salt of methane sulfonic acid, sulfuric acid or mixtures of these salts. The agent to insolubilize the multivalent metal cations is preferably hydroxide ions formed at the cell cathode. The catholyte is fed to the reactor electrolyte at a rate to maintain the pH of the reactor electrolyte, preferably at a value higher than the pH at which all metal cations form hydroxides. The pH can be varied over a broad range but preferably the pH is greater than five and less than 13. The reactor electrolyte may contain other anions or agents to chelate, complex or insolubilize metal cations.

The catholyte of the instant process can be any aqueous electrolyte suitable for forming a soluble hydroxide. Preferably, the catholyte is an aqueous solution of an alkali hydroxide.

There are several ways to separate and remove the insoluble stannous and ferrous hydroxides from the reactor electrolyte. A preferred method is to filter the reactor electrolyte in a plate and frame press substantially free of air and to return the filtrate to the reactor electrolyte and retain the hydroxide cake in the press for dissolution of the ferrous hydroxide. Preferably, the filter cake is contacted with an acidic aqueous solution suitable for dissolving the ferrous hydroxide and leaving the stannous hydroxide undissolved. An acidic solution, preferably of methane sulfonic acid or sulfuric acid, is used to dissolve the ferrous hydroxide. Preferably, the pH of the dissolving solution is greater than three. The stannous hydroxide is preferably dissolved in the feed electrolyte or tin plating electrolyte and made part of the plating electrolyte. A second preferred method is to dissolve the filter cake to form ferrous and stannous salts and then to increase the pH of the solution to precipitate the stannous ions. The stannous precipitate is removed from the solution and dissolved in an acid or electrolyte for use. The solution of ferrous salt can be put to use or the pH of the solution increased to precipitate the ferrous ions for removal from the solution. To prevent oxidation of the ferrous ions to ferric ions, it is essential to effect removal of the hydroxides from the reactor electrolyte, separation and dissolution of the hydroxides in a substantial air-oxygen free environment.

The ferrous and stannous ions can be separated by changing the pH of the reactor electrolyte using acids, bases and by an electrodialytic process. The pH of the reactor solution can be made less than the pH at which ferrous hydroxide forms a soluble salt and the stannous hydroxide removed by filtration. The pH of the reactor electrolyte could then be increased to precipitate ferrous hydroxide and the ferrous hydroxide removed by filtration. The pH of the reactor electrolyte can be changed electrodialytically to effect separation of metal cations as metal hydroxides. The electrodialytic process could be carried out in a cell having at least an anolyte, a feed electrolyte, a reactor electrolyte and a catholyte separated by cation permeable membranes or in a cell where the feed electrolyte is separated from the anolyte by an anion permeable membrane and the catholyte by a cation permeable membrane. When an electrolyzing current is passed through the cell having an anion and a cation permeable membrane, hydrogen ions are formed at the cell anode, acid anions, i.e., sulfate-methane sulfonate, migrate from the feed electrolyte to the anolyte and form acids and sodium ions migrate from the feed electrolyte to the catholyte and form sodium hydroxide. The pH of a portion of the reactor electrolyte is increased using the anolyte to dissolve ferrous hydroxide and the stannous hydroxide is removed by filtration and the pH of the reactor electrolyte is increased to precipitate the ferrous ions which are removed by filtration and the reactor electrolyte returned for use. It should be understood that other cell configurations and additives could be used to effect separation of metal cations.

The anodes of the instant process may be an electrically conductive, electrolytically active material resistant to the anolyte. Materials such as a valve metal of titanium, tantalum or alloys thereof bearing on its surface a noble metal or a noble metal oxide are generally preferred. The anodes may be a ceramic of reduced oxides of titanium. Foraminous anodes are generally preferred.

Cathodes of this invention can be any electrically conductive material resistant to the catholyte. Such materials as graphite, reduced oxides of titanium, iron, nickel, titanium, copper and stainless steel may be used in solid or foraminous form.

Any cation permeable membrane can be used in the instant process that is stable to the chemicals at operating conditions and mechanically suitable for economical design, construction and operation. Perfluocarbon membranes such as Nafion®, made by Dupont and Flemion®, made by Asahi Glass are preferred separators. It should be understood that the separators of the electrolytes of this invention could be solid or porous structures that are sufficiently permeable to cations and sufficiently impermeable to electrolytes as required for economical operation of the process. The preferred separators are substantially impermeable to the electrolytes and selectively permeable to cations.

A preferred electrochemical cell for separation of ferrous ions from a stannous tin plating electrolyte is shown in FIG. 1. The anolyte prevents the ferrous and stannous ions from contact with the cell anode and the reactor electrolyte provides a non-cathodic electrolyte for converting the metal cations to insoluble hydroxides without metal deposition on the cell cathode. The ferrous ions could be removed from the plating electrolyte using a three compartment cell without a reactor compartment by electroplating part or all of the stannous ions as tin on the cell cathode and removing the ferrous ions as ferrous hydroxide from the catholyte. The catholyte would be an electrolyte equivalent to the reactor electrolyte of the four compartment cell. Unfortunately, the tin does not readily dissolve in methane sulfonic acid and cannot be easily returned, as the stannous hydroxide is, to the plating electrolyte.

To illustrate the practice of the instant invention, an electrochemical system was assembled as shown schematically in FIG. 1. It will be understood that cells have compartments divided by membranes and, at times, a tank connected to a compartment and that a compartment may be referred to as an electrolyte. The electrochemical cell had an anolyte (1), an anode (2), a feed electrolyte (3), a reactor electrolyte (4), a catholyte (5), and a cathode (6). The electrolytes were separated by Nafion® 417 perfluorinated cation permeable membrane CM1 and CM2 and Nafion® 350 cation permeable membrane CM3. The electrolysis area was 929 sq. cm. based on the area of one membrane in contact with an electrolyte. The anode was a titanium mesh coated with iridium oxide and the cathode a titanium mesh coated with nickel. The feed electrolyte was a used Ronastan TP plating electrolyte containing ferrous ions obtained from the LeaRonal corporation. The feed electrolyte compartment was equipped for circulating the feed electrolyte form Tank A through the feed compartment and back to Tank A. The reactor electrolyte was a solution of 118 g/l of sodium methane sulfonate. The reactor electrolyte compartment was equipped to add catholyte, measure and control the pH, filter the electrolyte to remove solid hydroxides and to circulate the reactor electrolyte from Tank B through the reactor compartment and back to Tank B. The catholyte was a 10 wt. % solution of sodium hydroxide. The catholyte compartment was equipped for addition of water, venting of hydrogen gas and dispensing catholyte to the reactor electrolyte. The anolyte compartment containing an 8 wt. % solution of methane sulfonic acid was equipped for venting oxygen and adding water. A rectifier, having an output of 150 amperes direct current and 0–12 volts, was connected to the electrodes and equipped to operate at fixed current and variable voltage or fixed voltage and variable current. Provisions were made for sampling all electrolytes and for controlling volume of electrolytes, controlling pH of the reactor electrolyte and measuring pH of the feed electrolyte.

The solid metal hydroxides were removed from the electrolyzer by filtration (7) and the ferrous and stannous hydroxides separated. An acid leachate (8) was circulated through the press to dissolve the ferrous ions (9) and the leachate with ferrous ions removed from the filter. The feed electrolyte or acidic solution (11) was circulated through the filter to dissolve the stannous hydroxide and the solution (12) returned to the acidic solution, plating electrolyte or feed electrolyte.

EXAMPLE A

The electrochemical system described and shown in FIG. 1 was operated continuously at 60 amperes starting with a feed electrolyte containing 20 g/l of stannous tin, 10 g/l of ferrous iron, two proprietary additives, 1.0 g/l of stannic tin and 60 g/l of methane sulfonic acid. The pH of the reactor electrolyte was maintained at 9.0–9.5 by adding sodium hydroxide from the catholyte. Solid hydroxides were filtered from the reactor electrolyte in a filter press. The filter cake was leached with a solution of methane sulfonic acid until the pH of the leachate was 3.5. The residual cake was rinsed with water and then dissolved in the feed electrolyte. The leachate was tested for and found to be ferrous iron. A material mass balance showed that the stannous and ferrous ions were removed in accordance with Faraday's law and 97% of the stannous ions removed from the feed electrolyte were accounted for when the removed stannous hydroxide was dissolved. Approximately 95% of the ferrous ions removed were accounted for in the filtered leachate. There was some loss obvious because of oxidation of the ferrous iron during handling and analysis. There was no measurable loss of the additives in the Ronastan TP electrolyte into the reactor electrolyte or catholyte.

EXAMPLE B

The electrochemical system of Example A was used with the exception that the anolyte was a 8 wt. % solution of sulfuric acid, the reactor electrolyte a solution of sodium sulfate containing sodium hydroxide, maintained at a pH of 8. The feed electrolyte was a used Ronastan TP tin plating electrolyte containing 5 g/l of ferrous iron. The system operated essentially the same as in Example A. The solid hydroxides were filtered from the reactor electrolyte in a large Buchner funnel having a nitrogen blanket. The filtrate was returned as the reactor electrolyte. The cake of hydroxides was dissolved in sulfuric acid, pH of 1.5, and the pH adjusted with sodium hydroxide to a pH of 3.5 and the slurry filtered. The cake was 92% stannous tin and 4 wt. % stannic tin. The filtrate contained essentially ferrous iron. Over 97% of the ferrous, stannous and stannic ions removed from the Ronastan TP electrolyte was accounted for in the solids filtered from the reactor electrolyte.

EXAMPLE C

The electrochemical system of Example A was used with the exception that the reactor electrolyte was removed and the cell converted to three compartments. The catholyte was replaced by the sodium methane sulfonate reactor electrolyte of Example A. The pH of the catholyte was 9.0 to 9.5. After two hours of operation, the catholyte was filtered in a nitrogen atmosphere and the filtrate returned as catholyte. The filter cake of hydroxides was dissolved in methane sulfonic acid, pH of 1.5, and the pH of the solution of hydroxides was increased to 4.0 to precipitate stannous hydroxide. This solution was filtered, the filter cake rinsed with water, the rinse and filtrate discarded, and the filter cake of stannous hydroxide dissolved in a methane sulfonic acid solution having a pH of 1.0. Approximately 2% of the tin removed was deposited on the cell cathode. Increasing the pH of the catholyte increased deposition of tin.

EXAMPLE D

The electrochemical cell of Example A was used. The anolyte was a 6 wt. % solution of sulfuric acid; the feed electrolyte, a plating electrolyte containing 20 g/l of stannous tin, 100 g/l of phenyl sulfonic acid, 5 gal of ferrous iron and two plating aids; the reactor electrolyte, a 11 wt. % solution of sodium sulfate; and the catholyte, a 10 wt. % solution of sodium hydroxide. The pH of the reactor electrolyte was controlled at 9.5 by adding sodium hydroxide.

The process was operated at 60 amperes and 5 volts. Stannous and ferrous hydroxides formed in the reactor electrolyte and were removed by filtration. The filter cake was leached with a solution of methane sulfonic acid until the pH of the leachate remained at 3.5. The residual filter cake was rinsed with a methane sulfonic acid solution having a pH of 3.5 to remove residual ferrous ions. The cake was then dissolved in the feed electrolyte. The process with a phenyl sulfonic acid electrolyte operated in an equivalent way to the operation with a methane sulfonic acid based electrolyte such as Ronastan TP.

EXAMPLE E

The reactor electrolyte of Example A containing sodium sulfate, stannous and ferrous hydroxides was fed to an electrochemical cell having an anolyte, a feed electrolyte and a catholyte. The feed electrolyte was separated from the anolyte by an anion permeable membrane and from the catholyte by a cation permeable membrane. The anolyte was a solution of sulfuric acid, the feed electrolyte is the reactor electrolyte and the catholyte was a solution of sodium hydroxide. The reactor electrolyte was fed continuously to the cell. When an electrolyzing current was passed through the cell, hydrogen ions are formed in the anolyte, sulfate or methane sulfonate ions migrate from the feed electrolyte to the anolyte and form acids with the hydrogen ions. Sodium ions migrate from the feed electrolyte to the catholyte and form sodium hydroxide with hydroxide ions formed in the catholyte. A portion of the reactor electrolyte is then treated with the anolyte to decrease pH and with the catholyte to increase pH. The electrodialytic method essentially eliminates the use of chemicals, acid and base, for separation of the ferrous and stannous ions.

What is claimed:

1. A process using an electrochemical cell having at least an anolyte, a feed electrolyte, a reactor electrolyte and a catholyte for conversion of salts of ferrous ions and stannous ions in an acidic solution into insoluble hydroxides of said ferrous and said stannous ions and separating said ferrous ions from said stannous ions and returning said stannous ions to said acidic solution which comprises: (a) feeding said acidic solution selected from solutions having an acid and at least salts of ferrous and stannous ions as said feed electrolyte; (b) passing an electrolyzing current through said cell to (1) form hydrogen ions in said anolyte; (2) electrotransport through cation permeable membranes said ferrous ions and said stannous ions from said feed electrolyte to said reactor electrolyte; (3) react said stannous ions and said ferrous ions with hydroxide ions in said reactor electrolyte to form insoluble stannous and ferrous hydroxides; (4) form hydroxide ions in said catholyte; (c) removing said insoluble stannous hydroxides and said insoluble ferrous hydroxides from said reactor electrolyte (d) dissolving said ferrous hydroxide in an aqueous solution; (e) separating said dissolved ferrous hydroxide from said insoluble stannous hydroxide; (f) dissolving said insoluble stannous hydroxide in an aqueous solution; and (g) adding said solution of said stannous hydroxide to said feed electrolyte.

2. The process of claim 1 wherein said acid in said acidic solution is methane sulfonic acid or phenyl sulfonic acid or sulfuric acid or mixtures of these acids.

3. The process of claim 1 wherein said solution for dissolving said ferrous hydroxide is a solution having a pH greater than the pH that dissolves stannous hydroxide.

4. The process of claim 1 wherein said aqueous solution for dissolving said stannous hydroxide contains methane sulfonic acid, phenyl sulfonic acid, sulfuric acid or mixtures of these acids.

5. A process using an electrochemical cell having at least an anolyte, a feed electrolyte and a catholyte for converting salts of ferrous and stannous ions in an acidic solution into insoluble hydroxides of said ferrous and said stannous ions and separating said stannous ions from said ferrous ions which comprises: (a) feeding said acidic solution selected from solutions containinig an acid and salts of ferrous and stannous ions to said cell as said feed electrolyte; (b) passing an electrolyzing current through said cell to (1) form hydrogen ions in said anolyte; (2) electrotransport through cation permeable membranes said hydrogen ions from said anolyte to said feed electrolyte; (3) electrotransport through cation permeable membranes said stannous ions and said ferrous ions from said feed electrolyte to said catholyte, (4) form hydroxide ions in said catholyte; (5) react said stannous ions and said ferrous ions with said hydroxide ions to form insoluble ferrous hydroxide and insoluble stannous hydroxide; (c) dissolving said ferrous hydroxide as a salt, chelate or metal complex; and (d) separating said insoluble stannous hydroxide from said salt, chelate or metal complex of said dissolved ferrous hydroxide.

6. The process of claim 5 wherein said acid in said acidic solution is methane sulfonic acid, phenyl sulfonic acid or sulfuric acid.

* * * * *